United States Patent [19]

Tada

[11] 3,943,353

[45] Mar. 9, 1976

[54] DISASSEMBLABLE DECORATIVE LIGHT FIXTURE

[76] Inventor: Minami Tada, No. 9-11, Kugayama 4-chome, Suginami, Tokyo, Japan

[22] Filed: May 23, 1974

[21] Appl. No.: 472,541

[52] U.S. Cl. ..... 240/10 R; 240/78 LK; 240/108 D

[51] Int. Cl.[2] ..... F21P 1/02; F21S 1/06

[58] Field of Search .... 240/10 R, 10 D, 10 B, 78 R, 240/78 LK, 108 R, 108 D, 85 B, 78 E, 10 T; D48/16 C, 16 D; 161/68, 13–14, 17, 111

[56] References Cited

UNITED STATES PATENTS

| | | | |
|---|---|---|---|
| 1,934,624 | 11/1933 | Guth | 240/85 B |
| 2,513,565 | 7/1950 | Johnson | 240/10 T |
| 2,801,331 | 7/1957 | Lipscomb | 240/108 D |
| 3,321,622 | 5/1967 | Wellhofer et al. | 240/108 R |

FOREIGN PATENTS OR APPLICATIONS

| | | | |
|---|---|---|---|
| 2,049,706 | 4/1972 | Germany | 240/10 |

*Primary Examiner*—Richard M. Sheer
*Assistant Examiner*—James LaBarre

[57] ABSTRACT

There is described a decorative lamp fixture having its main components detachably connected to a flat base structure so that the assembly can be disassembled into pieces to allow packing or storage in a small space. The assembly includes chains of decorative elements of a light transmissive or reflective material. The chains of the decorative elements are arranged around an electric lamp in a density suitable for hiding the lamp from direct external view. When the lamp is lit, the light rays are transmitted through or reflected on the surfaces of the chained decorative elements producing splendid optical effects which add beauty to a room or other places.

9 Claims, 3 Drawing Figures

DISASSEMBLABLE DECORATIVE LIGHT FIXTURE

FIELD OF THE INVENTION

This invention relates to a disassemblable decorative light fixture or assembly employing chains of decorative elements hung around a lamp in a desired density and length to obtain optimum decorative effects.

More particularly, the invention concerns a decorative light fixture assembly which can be easily separated into pieces and put away in a reduced volume to allow the entire fixture to be packed or stored in a small container. The light fixture employs decorative elements which are so shaped that they can be easily connected into chains of a suitable length and hung around the lamp in a suitable density to hide the lamp from direct outer view. The chains of the decorative elements arranged around the lamp glow and gleam when the lamp is lit to create a delightful atmosphere in a room or other places.

SUMMARY OF THE INVENTION

It is an object of the present invention to provide a decorative light fixture having component parts connected detachably to one another so that the assembly may be easily dismantled into pieces when desired.

It is another object of the present invention to provide a decorative light fixture having strands of chained decorative elements detachably hung around an electric lamp.

It is still another object of the present invention to provide a disassemblable decorative light fixture of the nature mentioned above, the assembly employing decorative elements which are so shaped as to allow easy linkage with one another to form chains around an electric lamp.

It is a further object of the present invention to provide a disassemblable decorative light fixture of the nature mentioned above, the assembly employing decorative elements of a light transmissive or reflective material around an electric lamp so that the decorative elements glow and gleam when the lamp is lit.

It is still further object of the present invention to provide a decorative light fixture having component parts connected detachably to one another so as to facilitate cleaning of the component parts and replacement of the lamp.

According to the present invention, there is provided a decorative light fixture which comprises a flat base structure of a rigid material; a socket means securely mounted on and accessible from beneath the base structure; an elongated lamp support member having a mount at the upper end thereof with a plug member for electrical connection with said socket means and at the lower end thereof with an electric lamp; means for detachably holding said upper end of said lamp support member securely with respect to said socket means and said base structure; a plurality of decorative elements linked one to another to form strands of chained decorative elements; and a plurality of hook members mounted on the lower surface of said base structure for releasably hanging therefrom the chained decorative elements.

In a more particular form of the invention, the decorative light fixture comprises a flat base structure of a rigid material having an upper mounting plate and a lower reflective plate securely connected to said upper mounting plate; a socket means securely mounted on said upper mounting plate of said base structure and having an externally threaded portion projected downwardly outwardly through an aperture formed in said lower reflective plate; an elongated lamp support member having a mount at the upper end thereof with a plug member for electrical connection with said socket means and at the lower end thereof with an electric lamp; an internally threaded ring member fitted over said plug member and adapted to engage with the externally threaded portion of said socket means for holding said lamp support member securely with respect to said socket means and said base structure; a plurality of decorative elements linked one to another to form a plurality of strands of chained decorative elements; and a plurality of hook members mounted on the lower surface of said reflective plate for releasably hanging therefrom said chained decorative elements.

BRIEF DESCRIPTION OF THE DRAWINGS

The above and other objects, features and advantages of the invention will become clear from the following description and appended claims, taken in conjunction with the accompanying drawings which show by way of example a preferred embodiment of the invention and wherein:

DESCRIPTION OF PREFERRED EMBODIMENT

Figure 1:
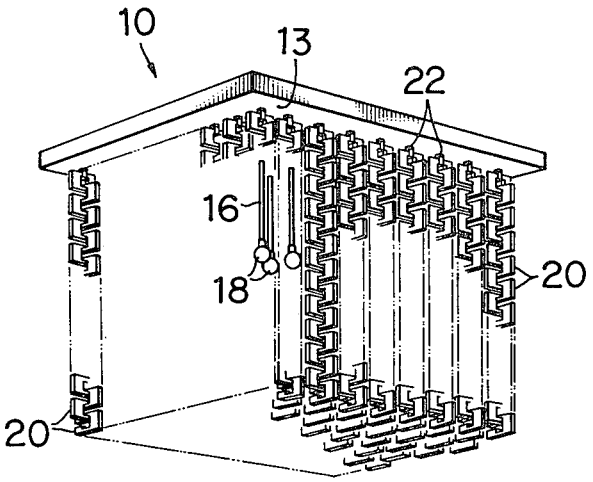
FIG. 1 is a perspective view showing a disassemblable decorative light fixture embodying the instant invention.

Referring now to the drawings, the disassemblable decorative light fixture of the invention is provided with a flat base structure 10 comprising a mounting plate 12 and a reflecting plate 13 coextensive with and covering the lower surface of the mounting plate 12. The base structure 10 is generally in a rectangular or circular form and has mounted on the mounting plate 12 a suitable number of sockets 14 each with an external thread 14*a*. The reflecting plate 13 is formed with openings 15 for receiving the externally threaded portion 14*a* of the socket 14. The socket 14 is attached by means of, for example, a nut (no number) to a U-shaped support which is fixed to the mounting plate 12.

A bulb support pipe 16 is hung from the base body 10 and is provided at the upper end thereof with a plug member 17 for engagement with one of the sockets 14, and at the lower end with an electric bulb or lamp 18. The plug 17 has an annular flange and has fitted thereover an internally threaded ring member 19 which is threaded over the socket 14 by engagement with the external thread 14*a*, thus allowing the for detachably fixing of the bulb support pipe 16 with respect to the base body 10.

Figure 3:
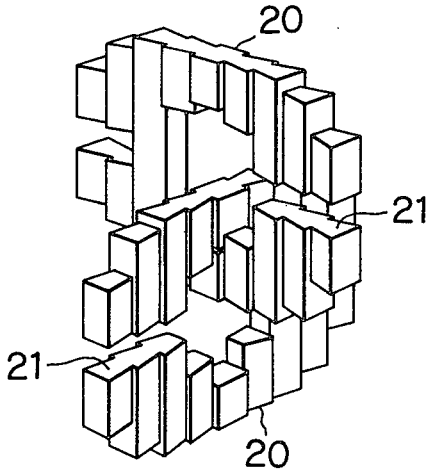
FIG. 3 is a perspective view showing on an enlarged scale the manner for connecting individual decorative elements to one another.
Figure 2:
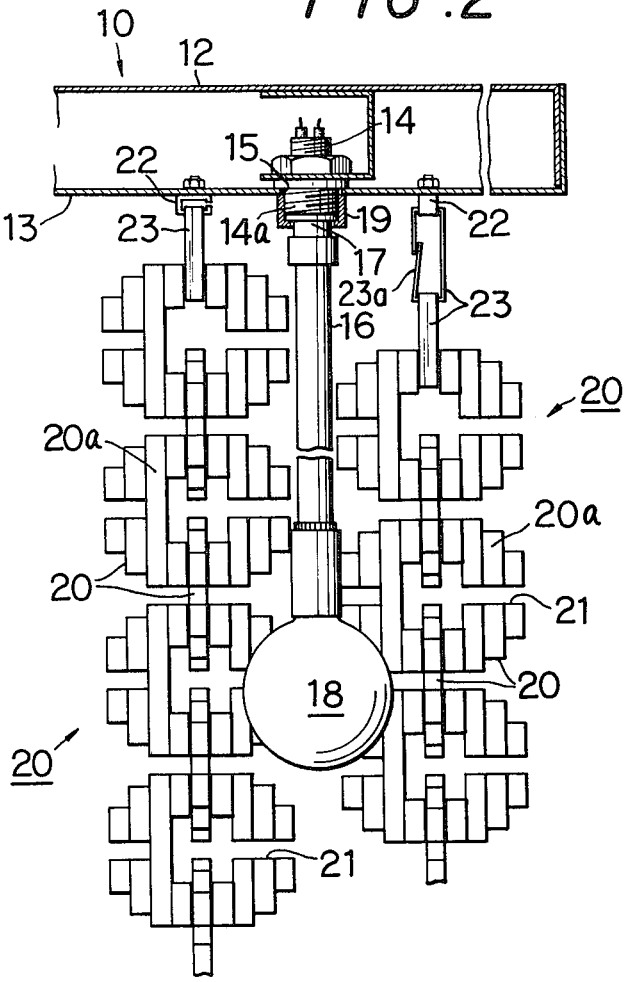
FIG. 2 is a side view partially in section showing on an enlarged scale the component parts of the decorative light fixture.

A plurality of chains of ornamental or decorative elements 20 are hung from the reflecting plate 13 of the base structure 10 at a suitable space from one another. Each chain consists of a number of linked decorative elements 20 which are, in the particular example shown in FIG. 3, formed by molding a transparent material such as acrylic resin in a substantially fancyful "C" shape with a multiple number of stepped reflective surfaces 20*a* on the sides thereof.

The decorative elements 20 are chained to a suitable length by passing a succeeding element through a space between the disconnected ends 21 of a preceeding element and a number of strands of chained decorative elements 20 are hung on hook members 22 which are securely mounted in suitable positions on the base structure 10, detachably by means of link members 23 each of a ring shape and with a flexible arm 23*a*.

It is preferred that the strands of the chained decorative elements be hung around the lamp 18 in sufficient number for hiding the lamp 18 from direct external view. Where the light fixture is mounted on a lofty or coved ceiling or opening, it is desirable to employ a long pipe for the support pipe 16 of the lamp 18, and at the same time to use a ball chain or other suitable metallic chains instead of the connecting ring 23 to arrange the decorative elements 20 around the lamp 18.

With the disassemblable decorative light fixture of the invention as described above, when the lamp 18 is lit, the light rays from the lamp 18 are transmitted through or reflected on the reflective surfaces of the decorative elements which are arranged around the lamp 18, brilliantly illuminating the clusters of decorative elements, without directly showing the lamp 18. The optical effects of the decorative elements 20 can be changed as desired by selecting suitable material therefor. In this connection, it is preferable that the decorative elements 20 be of transparent or translucent material, either with or without a color, in order not to destroy the transmission of the light rays from the lamp 18.

It will be appreciated from the foregoing description that, with the decorative light fixture of the invention, the decorative elements 20 may be provided in any desired shape, number and color and arranged in any desired form to give the most suitable optical and decorative effects to a room or other environment. As mentioned hereinbefore, the light fixture can be disassembled easily to allow the entire fixture to be packed or stored in a reduced volume. Particularly in the embodiment shown above, the base body 10 and the decorative elements 20 are provided with flat surfaces, so that the disassembled parts might occupy an extremely reduced volume and therefore might require only a small space when packing them or storing them.

The decorative elements 20 are herein shown and described as having a C shape in side view; however, it will be appreciated that they can be of various other shapes so long as they can form chains or elongated strands.

The invention has been described in detail with particular reference to a preferred embodiment thereof but it will be understood that many variations and modifications can be effected within the spirit and scope of the invention as defined in the appended claims.

What is claimed is:

1. A decorative light fixture comprising:

a flat base structure of a rigid material;

a socket means securely mounted on and accessible from beneath said base structure;

an elongated lamp support member having mounted at the upper end thererof a plug member for electrical connection with said socket means the lower end of the lamp support member being adapted to receive an electric lamp;

means for detachably holding said upper end of said lamp support member securely with respect to said socket means and base structure;

a plurality of decorative C-shaped elements loosely and removably linked directly one to another to form a flexible strand the length of which is determined by the number of said elements therein, there being provided a plurality of said strands of chained decorative elements; and a plurality of hook members mounted on the undersurface of said base structure, each said hook member including means for releasably supporting one of said strands of linked decorative elements in a vertical plane.

2. A decorative light fixture as defined in claim 1, wherein:

said flat base structure includes an upper mounting plate and a lower light-reflecting plate securely connected to said upper mounting plate and spaced therefrom;

said socket means being securely mounted on said upper mounting plate of said base structure and having an externally threaded portion projecting downwardly through an aperture formed in said lower reflecting plate;

an internally threaded ring member fitted over said plug member and adapted to engage with the external thread on said socket means for holding said lamp support member securely with respect to said socket means and said base structure;

said hook members being mounted on the lower surface of said light-reflecting plate for releasably hanging therefrom said linked decorative elements.

3. A decorative lamp assembly as defined in claim 1, wherein said supporting means comprises a number of link members for releasably-hanging said linked decorative elements on the respective hook members.

4. A decorative light fixture as defined in claim 3, wherein said link member is in the form of a ring.

5. A decorative light fixture as defined in claim 1, wherein said decorative elements are transparent.

6. A decorative light fixture as defined in claim 1, wherein said decorative elements are translucent.

7. A decorative light fixture as defined in claim 1, wherein said decorative elements are formed in a substantially flat shape and are provided with reflective surfaces on opposite sides thereof.

8. A decorative light fixture as defined in claim 3, wherein said decorative elements are hung in a density suitable for hiding the lamp support member from direct external view.

9. A decorative light fixture as defined in claim 2, wherein said elongated lamp support member is in the form of a hollow tube.

* * * * *